US008402963B2

(12) United States Patent
Justo

(10) Patent No.: US 8,402,963 B2
(45) Date of Patent: Mar. 26, 2013

(54) CONTAINER WITH IN SITU FOOD PRODUCT MIXING AND HEATING

(76) Inventor: Jose A. Justo, Newark, NJ (US)

( * ) Notice: Subject to any disclaimer, the term of this patent is extended or adjusted under 35 U.S.C. 154(b) by 1445 days.

(21) Appl. No.: 11/355,860

(22) Filed: Feb. 16, 2006

(65) Prior Publication Data

US 2007/0204851 A1 Sep. 6, 2007

(51) Int. Cl.
*A47G 23/04* (2006.01)

(52) U.S. Cl. ..... 126/262; 126/263.06; 126/263.07; 126/263.08; 126/263.09

(58) Field of Classification Search ..... 126/263.09, 126/263.08, 263.01, 262, 261, 246, 263.06, 126/263.07; 62/4, 60; 436/113; 206/219, 206/222, 22

See application file for complete search history.

(56) References Cited

U.S. PATENT DOCUMENTS

| | | | | |
|---|---|---|---|---|
| 3,746,198 | A * | 7/1973 | Howland | 215/11.1 |
| 4,387,998 | A * | 6/1983 | Szigeti | 366/130 |
| 5,638,968 | A * | 6/1997 | Baron et al. | 215/11.4 |
| 6,079,405 | A * | 6/2000 | Justo | 126/263.08 |
| 6,113,257 | A * | 9/2000 | Sharon et al. | 366/130 |
| 7,117,684 | B2 * | 10/2006 | Scudder et al. | 62/4 |
| 2005/0145242 | A1 * | 7/2005 | Romeu | 126/263.09 |
| 2005/0160743 | A1 * | 7/2005 | Dunwoody | 62/4 |

* cited by examiner

*Primary Examiner* — Alfred Basichas
(74) *Attorney, Agent, or Firm* — Okuley Smith LLC

(57) ABSTRACT

A container for housing and producing a liquid comestible product and in situ heating or cooling thereof is constructed for rotation of the lid to release a comestible powder into water. Rotation of the base causes a chemical reaction to be initiated for heating or cooling the comestible powder/water blend.

13 Claims, 3 Drawing Sheets

CONTAINER WITH IN SITU FOOD PRODUCT MIXING AND HEATING

CROSS-REFERENCE TO RELATED APPLICATIONS

None.

STATEMENT REGARDING FEDERALLY SPONSORED RESEARCH

Not applicable.

BACKGROUND OF THE INVENTION

The present invention generally relates to packaging containers for a variety of, inter alia, beverages and other liquid comestibles, and more particularly to packaging containers that permit such liquid comestibles to be made from dry mixes and water in the field along with heating of the thus-formed liquid comestibles.

A variety of liquid comestibles have limited shelf life and/or require refrigeration. Consumers of such products, however, often are required to consume such liquid comestibles when they are not at home and/or do not have access to refrigeration facilities. For example, a variety of foodstuffs will spoil if they are not refrigerated. The same is true for a variety of pharmaceutical products. Risk of spoilage due to bacterial contamination translates into a limited useful life of the product absent refrigeration. In other contexts, liquid comestible products may require heating for sterilization, organoleptic properties, etc. Thus, not only does the consumer require that the liquid comestible be refrigerated prior to ingestion, but often the comestible must be heated prior too.

The art has addressed the foregoing dilemma and proposed a variety of packing containers. For example, U.S. Pat. No. 5,388,565 proposes a self-heating container system for heating beverages or food, wherein the container has an upper chamber filled with water separated by a thin plate from a lower chamber filled with lime. Sharp spikes can be depressed from outside the container to pierce the thin plate.

U.S. Pat. No. 4,528,218 proposes a similar heating system for heating or cooling foodstuffs wherein an external lock-out system prevents unintended piercing of the diaphragm and premature heating/cooling of the foodstuff.

U.S. Pat. No. 3,596,801 proposes a liquid/powder foodstuff mixing container with a piercing tool actuated from outside the container to pierce a diaphragm separating the water and powder. No heating or cooling is shown.

U.S. Pat. No. 5,514,394 proposes a similar mixing container for dry cereal and milk.

U.S. Pat. No. 5,461,867 proposes a self-heating container system for heating beverages or food much like that system in the '565 patent.

U.S. Pat. Nos. 4,753,085 and 5,205,277 propose other self-heating container system variants to the '565 and the '867 patents.

U.S. Pat. No. 6,257,428 proposes a baby bottle having a pair of vertically stacked reservoirs, one for water and one for powder, separated by a movable closure (e.g., see FIG. 15).

U.S. Pat. No. 6,113,257 also proposes a baby bottle having a pair of vertically stacked reservoirs, one for water and one for powder, separated by a movable closure.

U.S. Pat. No. 6,003,728 proposes a vessel housing two products separated by a membrane that can be pushed with an external rod for mixing of the products.

U.S. Pat. No. 5,863,126 proposes screwing together two bottles, each containing a product, wherein with joining of the bottles a movable closure is moved to cause mixing of the products.

U.S. Pat. No. 5,353,961 proposes a bottle with an upper and lower bellows chamber connected by a one-way valve. The upper bellows chamber is moved downwardly to force the contents of the lower chamber through the one-way valve and into the upper chamber.

U.S. Pat. No. 5,417,321 proposes a bottle with an upper container and a lower container separated by a diaphragm that is puncturable from the outside.

U.S. Pat. No. 5,275,298 proposes a baby bottle having an upper and lower chamber separated by a rotatable ball having a penetrating shaft wherein rotation of the ball causes the chambers to be in fluid communication.

U.S. Pat. No. 5,088,627 proposes a container with upper and lower chambers separated by a tubular closure moveable to provide communication between the chambers.

U.S. Pat. No. 5,088,770 proposes a bottle of an upper and a lower chamber separated by a membrane, which can be punctured to provide communication between the chambers.

U.S. Pat. No. 4,779,722 proposes a container with 3 or more chambers, each separated by a valve manually operable from outside.

U.S. Pat. No. 4,950,237 proposes a bottle of an upper chamber and a lower bellows chamber separated by a stopper that is released when the lower bellowed chamber is expanded.

U.S. Pat. No. 4,936,446 proposes a bottle having an upper and a lower chamber separated by a closure that moves when the upper bottle cap is screwed.

U.S. Pat. No. 3,856,138 proposes a bottle composed of a pair of annularly disposed chambers wherein the upper chamber can be moved upwardly to unseal their connection so that contents within each chamber can mix.

U.S. Pat. No. 6,079,405 proposes a container for housing and producing a liquid comestible product and in situ heating thereof has an upper comestible chamber and a lower comestible chamber separated by a comestible diaphragm. One of the comestible chambers retains a dry powder and the other comestible chamber retains water. A moveable pierce rod assembly penetrates from outside the container to inside the upper comestible chamber and is attached to an arm disposed outside of the container. A removable protective collar is disposed between the arm and the container to retain the arm and pierce rod assembly in place. A flexible collar is disposed within the protective collar to seal the pierce rod assembly between the arm and the container. The lower chamber houses an upper heating/cooling chamber and a lower heating heating/cooling chamber separated by a heating heating/cooling diaphragm. One of the heating heating/cooling chambers retains a chemical reactant and the other heating heating/cooling chamber retains water. A moveable plunger retains by a flexible plunger diaphragm and is hand actuated from outside the container. The plunger is disposed to penetrate through and rupture the heating heating/cooling diaphragm when actuated from outside the container to combine the chemical reactant and water for generating/withdrawing heat to heat/cool the contents of the lower chamber. A dispensing tube is provided for removing the liquid comestible product from the container. Removal of the protective collar permits the pierce rod to be actuated from outside of the container for releasing contents in the upper comestible chamber into contents in the lower comestible chamber for producing a liquid comestible product from the powder and the water. The liquid comestible product can be heated/cooled by actuating the plunger to rupture the heating diaphragm.

Despite these proposals, there still is a need in the art for a simple, yet reliable container that can house separately liquid and powder for admixing in the field, followed by heating of the in situ formed liquid comestible in the same container. The present invention is addressed to such need.

BRIEF SUMMARY OF THE INVENTION

The invention is a container for housing and producing a liquid comestible product and in situ heating or cooling thereof. The container includes an annular housing (14) having an upper threaded neck (34) and an open upper end and an open lower end. A base (28) is rotatable affixed to the housing lower end. A sealing member (16) is disposed within the annular housing and has a sealing disk (36), which mates against the annular housing for form an upper comestible chamber (38) for retaining a comestible powder and a lower a mixing chamber (44) for retaining a comestible liquid. An inner annular heating shell (18) is disposed within the annular housing and is affixed to the base for rotation therewith. A liquid water bag (20) is disposed within the heating shell for housing liquid water. A heat transfer bag (22) is disposed within the heating shell for containing a chemical reactant. A cutter (26) is carried by the heating shell and disposed so that rotation of the base urges rotation of the heating shell which carries the cutter into contact with the liquid water bag for release of contents of the liquid water bag for contact with the heat transfer bag resulting in the generation of heating or cooling for heating or cooling contents in the comestible chamber.

Advantages of the present invention include the ability to carry the container to remote locations devoid of refrigeration. Another advantage is the ability to mix the dry powder and water via hand activation to form a liquid comestible product. A further advantage is the ability to hand-activate a heating system also housed with the container for heating the liquid comestible product. A yet further advantage is the ability to enhance the ability of the water to dissolve the dry powder by the heating of the water. A yet another advantage is the ability to adapt the container to have a baby bottle configuration for feeding formula infants. Still a further advantage is the ability to adapt the container to be used by children and adults. Still another advantage is the ability to prepare both liquid nutritional products as well as liquid medicinal comestible products. These and other advantages will be readily apparent to those skilled in the art based on the disclosure set forth herein.

BRIEF DESCRIPTION OF THE DRAWINGS

For a fuller understanding of the nature and objects of the present invention, reference should be had to the following detailed description taken in connection with the accompanying drawings in which.

The drawings will be described in further detail below.

DETAILED DESCRIPTION OF THE INVENTION

Figure 1:
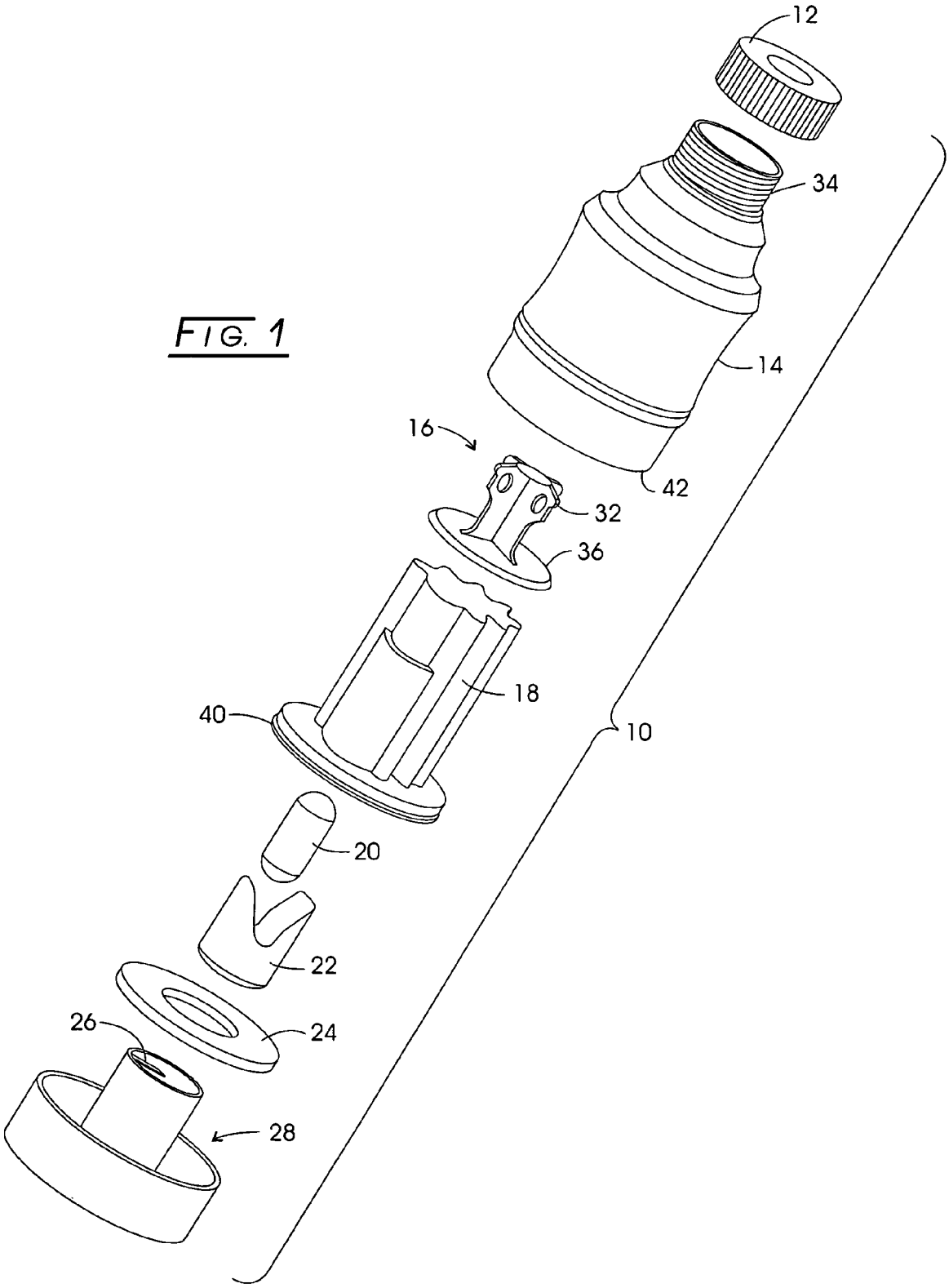
FIG. 1 is an exploded perspective view of the container showing all of the components.

Referring initially to FIG. 1, a container, 10, is seen to be composed of the following components: a lid, 12; an outer housing, 14; an upper seal member, 16; an annular heating shell, 18, a liquid water bag, 20; heat transfer bag, 22; a sponge ring, 24; a cutter, 26; and a container base, 28. The components are assembled in the sequence illustrated in FIG. 1.

Figure 2:
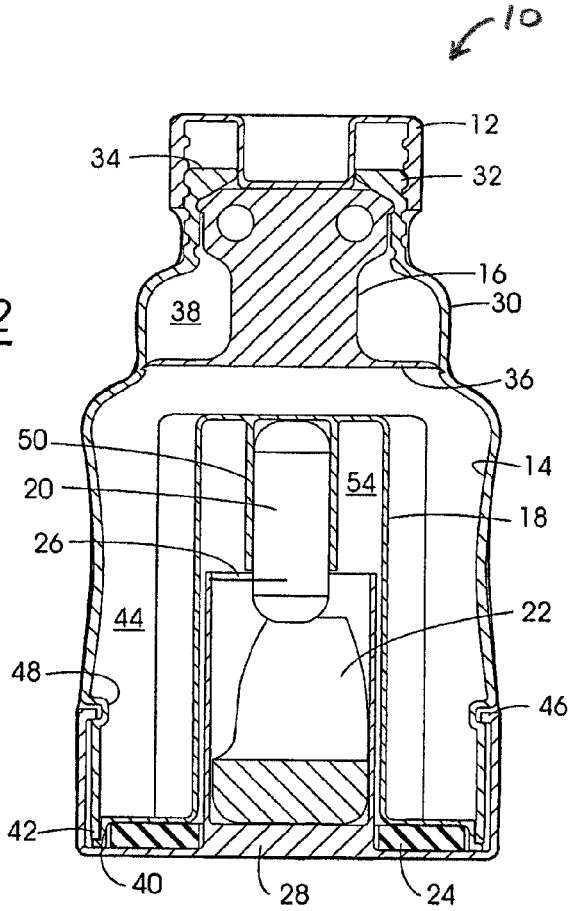
FIG. 2 is a cross-sectional elevational view of the container of FIG. 1 in its initial sealed and locked condition.

As assembled in a shipping condition, FIG. 2 shows an outer protective wrapping, 30, such as shrink wrapping, covering the entire outside surface of container 10. Such wrapping ensures that container 10 has not been tampered with between manufacturer and consumer/purchaser. Since a comestible, such a baby formula, can be dispensed from container 10, such safety wrapping 30 is of comfort to the consumer.

Outer housing 14 has an upper threaded neck, 34 (see FIGS. 1 and 2), adapted to receive lid 12, which is internally threaded for screwing lid 12 onto housing neck 32. Outer housing 14 functions as a bottle or container shell, which the user grasps for drinking heated/cooled liquid from container 10. Components 16-26 are housed with in the interior of outer housing 14, which is annular in configuration. Container base 28 mates with the opening at the bottom of housing 14 to form a closed container from which heated/cooled liquid is withdrawn from the upper opening on outer housing 14.

Container base 28 has an upper lip, 46, that fits within a recess or race, 48, formed in the lower portion of outer housing 14. Such interfit arrangement permits container base 28 to be rotated relative to outer housing 14. Such interfit arrangement also serves as (at least) a part seal between the outside environment and chamber 44.

Upper seal member 16 has upper seal projections, one being a seal projection, 32, which is in sealing contact with a container upper seal projection, 35. Upper seal member 16 also has a lower sealing disk, 36, which also mates with the inside surface of outer housing 14 and with upper seal projection 35 forms a upper chamber, 38, which can house, for example, comestible powder, such as, for example, baby formula powder, health/power drink powder, or the like. In fact, even a comestible liquid could be housed within upper chamber 38.

Heating shell 18 also is annular in configuration and desirably can be made with a large surface area, such as by being serpentine in configuration, as illustrated in FIG. 1. The lower annular edge, 40, of heating shell 18 sealingly mates with the lower annular lip, 42, of outer housing 14 to form a lower comestible chamber, 44, which can house a comestible liquid, such as, for example, water. Combing comestible powder in chamber 38 with comestible liquid in chamber 44 forms an ingestible drink, such as, for example, baby formula, sports drink, for the like.

Figure 3:
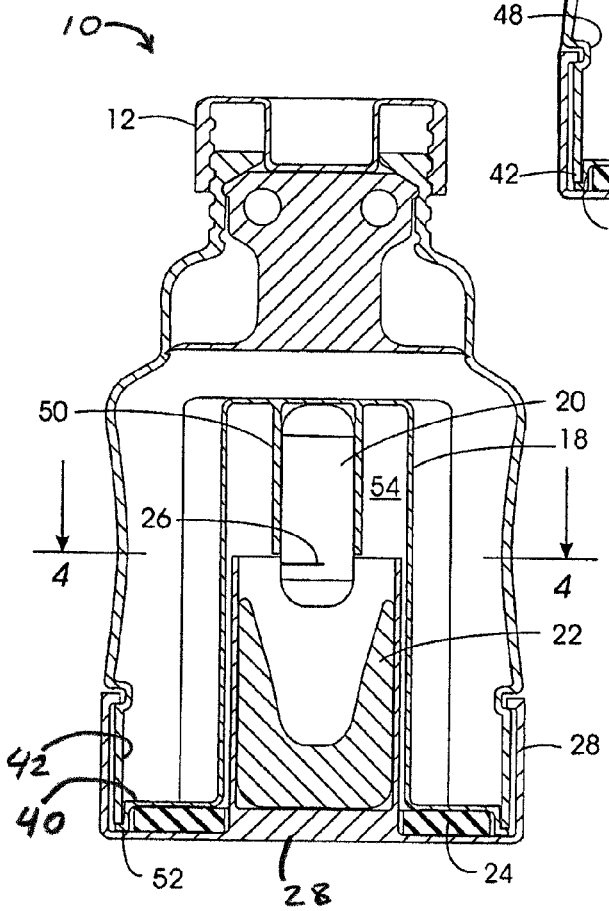
FIG. 3 is a cross-sectional elevational view of the container of FIG. 1 with the lower assembly partially rotated to heat a volume of liquid, such as water, in a mixing chamber.
Figure 4:
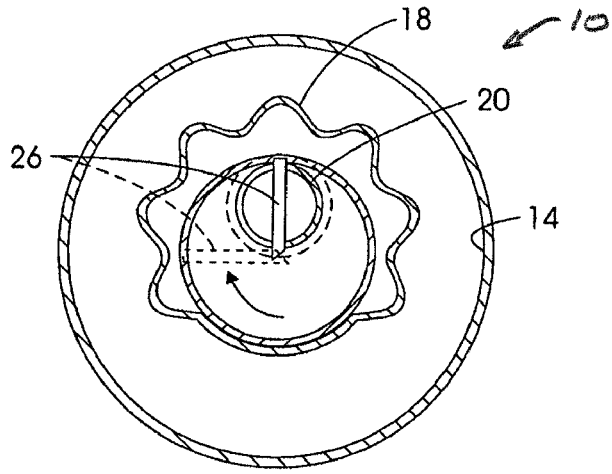
FIG. 4 is a cross-sectional view taken along line 4-4 of FIG. 3.

Referring now also to FIGS. 3 and 4, heating shell 18 has an inner chamber formed by a downstanding wall, 50, within which water bag 20 is retained. A lower flange, 52, of heating shell 18 also mates with lower annular lip 42 for sealing a chamber, 54, formed by annular heating shell 18 and also is part of the seal for chamber 44.

Cutter 26 is retained at the upper end of container base 28. Rotation of container base 28, relative to heating shell 18, then, results in the rotation of cutter 26. Rotating cutter 26 in turn punctures liquid water bag 20 releasing its contents— water—which falls down inside the lower volume of chamber 54 and in contact with heat transfer bag 22.

Heat transfer bag 22 retains therewithin a chemical reactant, which with water, results in either an exothermic or an endothermic chemical reaction. Released water from heat transfer bag 22 soaks into heat transfer bag 22 for such chemical reaction to occur. As to the chemical reactant in heat transfer bag 22, a variety of chemical reactants are well known in the art. These include, for example, alkaline earth oxide (e.g., CaO), glacial acetic acid, sulfuric acid, and the like. Such chemical reactants generate heat when combined with water (exothermic reaction) housed in heat transfer bag 22. It will be appreciated that other chemical reactants could be used that result in an endothermic reaction when mixed with water for the cooling of the contents in heat transfer bag 22. These reactants include, for example, ammonium nitrate, ammonium chloride, and the like.

The resulting chemical reaction heats/cools the water stored in chamber 44. It will now be appreciated that the serpentine or other increased surface area design of heating shell 18 increases the heating/cooling surface area for heating/cooling water in chamber 44 to be more rapidly heated/cooled.

Figure 5:
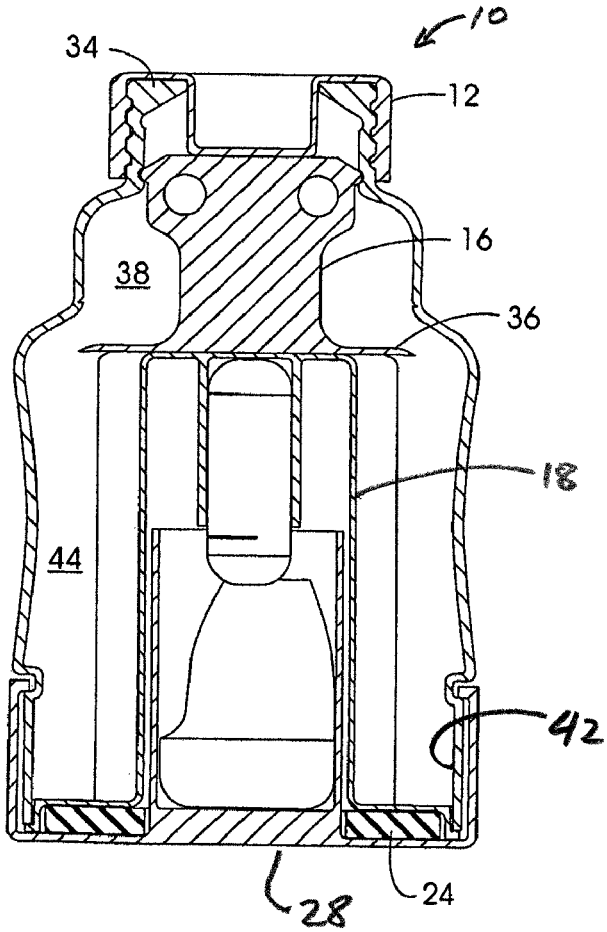
FIG. 5 is a cross-sectional elevational view like that in FIG. 3, but with the upper assembly partially rotated to mix the contents upper comestible chamber with the heated volume of liquid in the mixing chamber.

Referring now also to FIG. 5, rotation of cap 12 causes upper seal member 16 to be moved downwardly to disengage lower sealing disk 36 from contact with the inside surface of outer housing 14 and release the comestible powder housed in chamber 38 to be released and mix with the water stored in chamber 44. Simply shaking container 10 causes the powder and water to mix to form a comestible drink. Annular sponge 24 ensures that no liquid within chambers 44 and 54 can leak to outside container 10.

It will be appreciated by the skilled artisan that the powder in chamber 38 can be released into water chamber 44 before or after liquid water bag 20 is punctured for initiating the heating/cooling reaction for heating/cooling water in chamber 44.

Removal of cap 12 permits a use to drink from container 10. Alternatively, a conventional annular ring and nipple assembly can be screwed onto upper threaded neck 32 for forming a "baby bottle" from which an infant or toddler can ingest the heated/cooled contents housed within container 10.

Of course, materials of construction will be suitable for the types of comestible products being stored and heated (cooled) and will be able to withstand the temperatures generated in chamber 54, for example. Thus, temperature resistant plastics will be favored for their cost, disposability, and ability to withstand the expected temperatures to be encountered. Such plastics will include, for example, suitable acrylic polymers, polyolefin polymers, polyethylene terephthalate, and the like.

While the foregoing description has concentrated on nutritional comestible products, it will be appreciated that certain medicinal products (e.g., antibiotics) may come in powder form for admixing with water to product an oral or ingestive medicine for consumption by, for example, toddlers, children, and adults. Heating of such medicinal products could aid in their dissolution by heated water, aid in their efficacy, etc. The same can be said for cooling of the medicinal products, which may make them more organoleptically palatable. Thus, the inventive container could be used to provide a variety of ingestive products, either heated or cooled.

While the invention has been described with reference to various embodiments, those skilled in the art will understand that various changes may be made and equivalents may be substituted for elements thereof without departing from the scope and essence of the invention. In addition, many modifications may be made to adapt a particular situation or material to the teachings of the invention without departing from the essential scope thereof. Therefore, it is intended that the invention not be limited to the particular embodiments disclosed, but that the invention will include all embodiments falling within the scope of the appended claims. In this application, all citations referred herein are expressly incorporated herein by reference.

I claim:

1. A container for housing and dispensing a liquid comestible product and in situ heating or cooling thereof, comprising:

(a) an annular outer housing having an inside surface, an outside surface, an upper threaded neck, an open upper end, and an open lower end;

(b) a base rotatably engaged with the annular outer housing lower end;

(c) a sealing member disposed within said annular outer housing and further comprising a one or more upper seal projections and a sealing disk which mates against the inside surface of the annular outer housing forming a divided upper comestible chamber for retaining a comestible product and a lower mixing chamber for retaining a comestible liquid;

(d) a threaded lid engageable with the upper threaded neck, said lid projecting within the neck to contact the one or more upper seal projections;

(e) an inner annular heating shell disposed within said annular outer housing and affixed to said annular outer housing;

(f) a liquid water bag disposed within said inner annular heating shell for housing a quantity of water;

(g) a heat transfer bag for containing a chemical reactant disposed between said inner annular heating shell and said base; and (h) a cutter carried by said base and disposed so that rotation of said base urges rotation of said cutter into contact with said liquid water bag, wherein engaging the threaded lid with the upper threaded neck and advancing the threaded lid forces the sealing member into contact with the sealing member, thereby disengaging the sealing disk from contact with the inside surface of the annular outer housing and allowing mixing of the contents of the upper comestible chamber and the lower mixing chamber, and wherein rotation of the base relative to the annular outer housing pierces the liquid water bag and allows for release of the contents of said liquid water bag for contact with the contents of said heat transfer bag resulting in the generation of heating or cooling for heating or cooling contents in said comestible mixing chamber.

2. The container of claim 1, further comprising:

(i) an annular sponge mated against said base and surrounding said heating shell.

3. The container of claim 1, wherein said chemical reactant is one or more of alkaline earth oxide, CaO, glacial acetic acid, sulfuric acid, ammonium nitrate, and ammonium chloride.

4. The container of claim 1, which is manufactured from one or more of an acrylic polymer, a polyolefin polymer, or polyethylene terephthalate.

5. The container of claim 1, further comprising an internally threaded lid engaged with an externally threaded neck.

6. The container of claim 1, further comprising a removable shrink wrapping that indicates if product tampering has occurred.

7. The container of claim 1, wherein said chemical reactant is alkaline earth oxide.

8. The container of claim 1, wherein said comestible product is one or more of tea, broth, coffee, cocoa, juice, or baby formula.

9. The container of claim 8, wherein said comestible product is baby formula.

10. A container for housing and dispensing a liquid comestible product and for heating or cooling thereof, comprising (a) an annular outer housing having an inside surface, an outside surface, an externally threaded upper neck, an upper opening, and a lower opening;

(b) a rotatable base rotatably engaged with the annular outer housing lower opening;

(c) a sealing member disposed within said annular outer housing, said sealing member further comprising two or more upper seal projections and a circular sealing disk mating with the inside surface of the annular outer housing to form an upper comestible chamber for retaining a comestible powder divided from a lower mixing chamber for retaining a comestible liquid;

(d) an internally threaded lid engaging with the externally threaded upper neck, said lid projecting within the neck towards contact with the two or more upper seal projections;

(e) an inner annular heating shell disposed within and engaged with said annular outer housing;

(f) a first chemical reactant bag disposed within said inner annular heating shell for housing a first chemical reactant;

(g) a second chemical reactant, said second chemical reactant disposed between the inner annular heating shell and the rotatable base; and (h) a cutter carried by said rotatable base and disposed so that rotation of said rotatable base urges rotation of said cutter into contact with said first chemical reactant bag, wherein further advancing the threaded lid within the upper neck forces the lid into contact with the two or more upper seal projections, thereby disengaging the sealing disk from contact with the inside surface of the outer housing and allowing mixing of the contents of the upper comestible chamber and the lower mixing chamber, and wherein rotation of the rotatable base relative to the outer housing causes the cutter to pierce the first chemical reactant bag, thereby releasing the first chemical reactant into contact with the second chemical reactant and resulting in a chemical reaction capable of heating or cooling the contents in said comestible mixing chamber.

11. The container of claim 10 further comprising a container base with an upper lip, fitted within a race, said race formed in the lower portion of said outer housing wherein the interfit between the container base and the race allows the container base and the outer housing to be rotated relative to each other while forming a seal between the outside environment and chamber.

12. The container of claim 10 further comprising a two chamber heat transfer bag, each chamber of the two chamber heat transfer bag retaining separately a chemical reactant, wherein when said chemical reactants are mixed by puncturing, an exothermic or an endothermic chemical reaction occurs.

13. The container of claim 12 further comprising chemical reactants which are two or more of water, alkaline earth oxide, CaO, glacial acetic acid, sulfuric acid, ammonium nitrate, and ammonium chloride.

* * * * *